United States Patent [19]

Train

[11] 4,271,964

[45] Jun. 9, 1981

[54] FOLDING CARTON STRUCTURE

[75] Inventor: David B. Train, Midlothian, Va.

[73] Assignee: Reynolds Metals Company, Richmond, Va.

[21] Appl. No.: 81,166

[22] Filed: Oct. 2, 1979

[51] Int. Cl.[3] ..... B65D 5/46; B65D 5/54

[52] U.S. Cl. ..... 206/633; 206/624; 229/33; 229/52 B

[58] Field of Search ..... 206/611, 624, 631, 633; 229/33, 44 R, 36, 23 BT, 43, 52 B, 17 G; 220/11 B

[56] References Cited

U.S. PATENT DOCUMENTS

| | | | |
|---|---|---|---|
| 713,624 | 11/1902 | Ferres | 229/43 |
| 1,915,503 | 6/1933 | Schmidt . | |
| 1,954,201 | 4/1934 | Goodyear | 229/16 |
| 2,279,670 | 4/1942 | Ford et al. | 229/32 |
| 2,309,134 | 1/1943 | Morgan | 229/36 |
| 2,643,815 | 6/1953 | Komeo | 229/37 R |
| 2,936,941 | 5/1960 | Lewis | 229/23 BT |
| 2,990,992 | 7/1961 | Ellis | 229/16 |
| 3,064,876 | 11/1962 | Warner | 229/43 |
| 3,124,293 | 3/1964 | Transport | 229/16 |
| 3,195,796 | 7/1965 | Buttery | 206/633 |
| 3,281,054 | 10/1966 | Buttery et al. | 206/624 |
| 3,356,283 | 12/1967 | Champlin | 229/40 |
| 3,628,215 | 12/1971 | Everburg | 229/44 R |
| 3,724,741 | 4/1973 | Jacobson | 206/633 |
| 3,967,774 | 7/1976 | Querner | 229/43 |
| 3,968,922 | 7/1976 | Ruud | 229/33 |
| 4,029,207 | 6/1977 | Gordon | 229/52 B |
| 4,076,168 | 2/1978 | Ferri | 229/43 |

*Primary Examiner*—Stephen P. Garbe

*Attorney, Agent, or Firm*—Glenn, Lyne, Girard & McDonald

[57] ABSTRACT

A folding carton is disclosed which has particular utility for carrying beverage bottles, such as returnable beer bottles. The carton structure includes a rectangular bottom wall, upstanding front, side and rear walls being positioned perpendicular to the bottom wall, a rectangular top wall of lesser length and width dimensions than the bottom wall and trapezoidal connecting walls extending downwardly from the top wall, with the rear trapezoidal wall being hingedly affixed to the upstanding rear wall, resulting in a carton structure designed to closely confine the bottles. The carton may be end-loaded and top-unloaded, with the front and side trapezoidal walls having opening panels at their juncture with the side and front walls. In a preferred embodiment, the side opening panels act as reinforcing means for openings forming a portion of the side walls and used as carrying handles.

7 Claims, 9 Drawing Figures

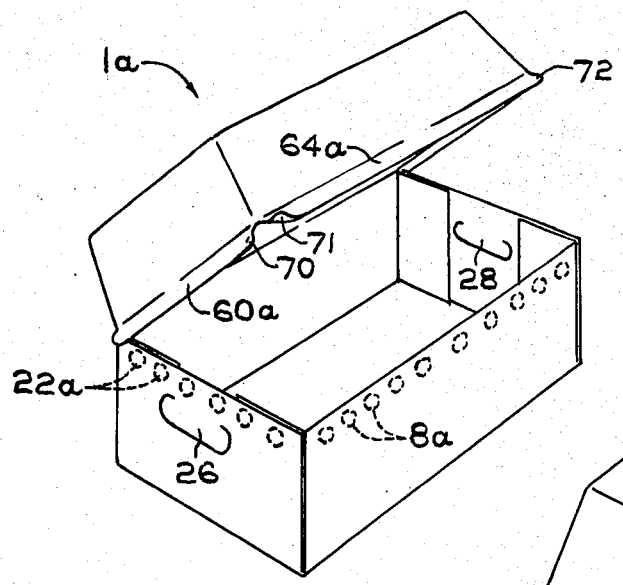
FIG. 1
FIG. 2
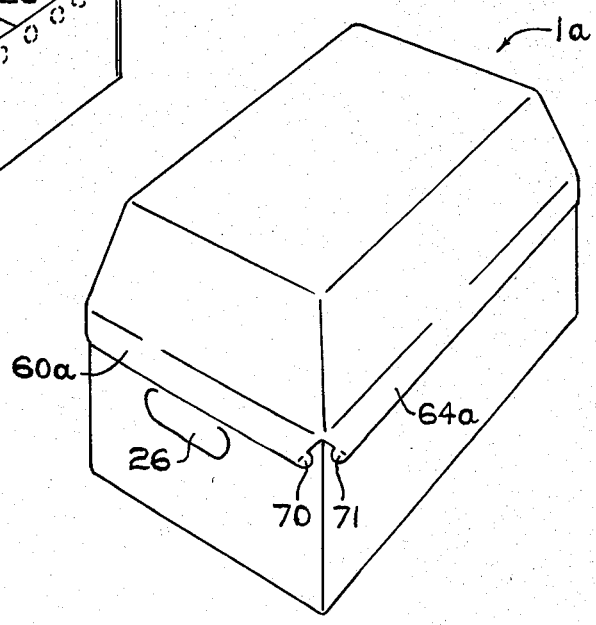
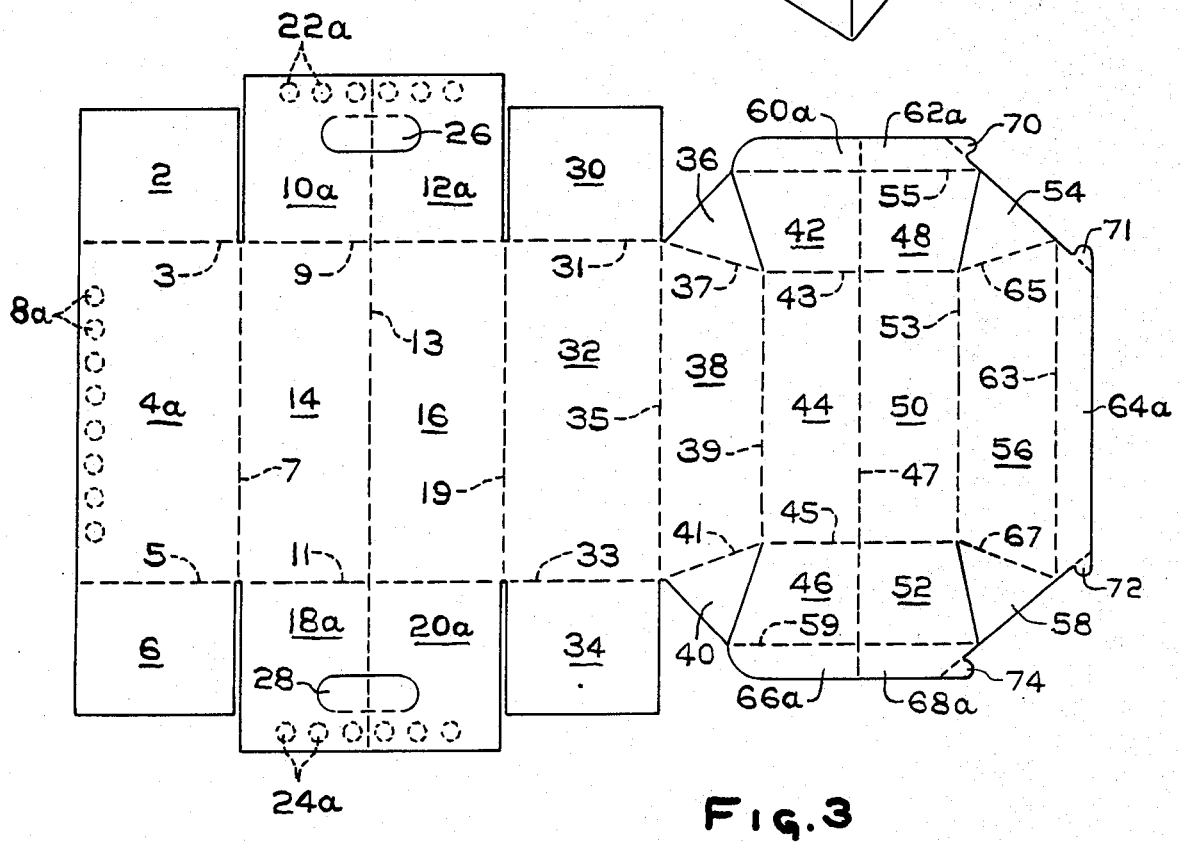
FIG. 3

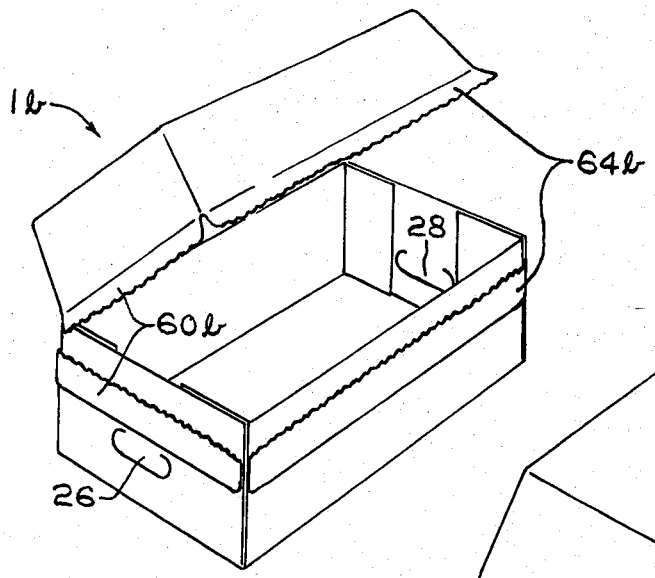
FIG. 4
FIG. 5
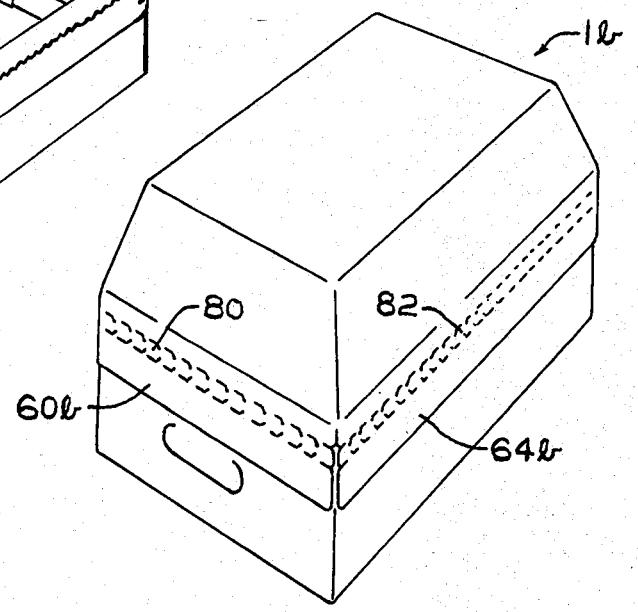
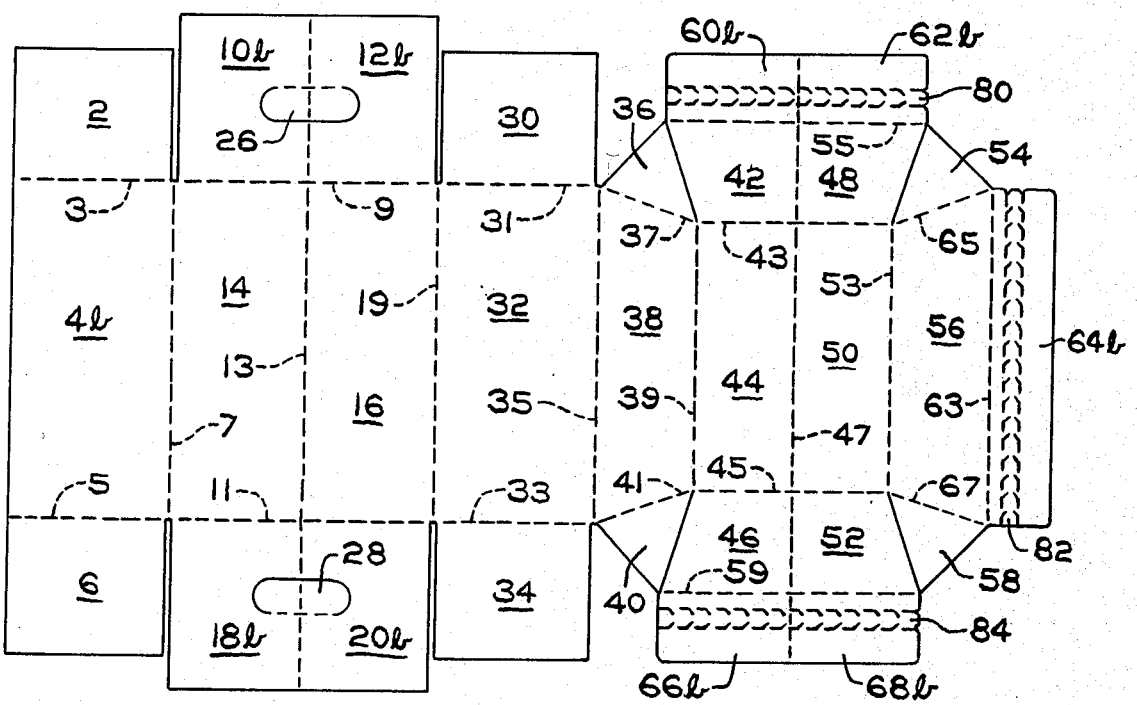
FIG. 6

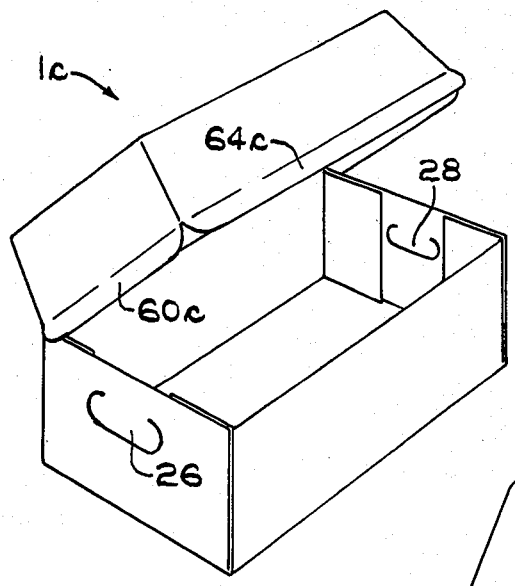
FIG. 7
FIG. 8
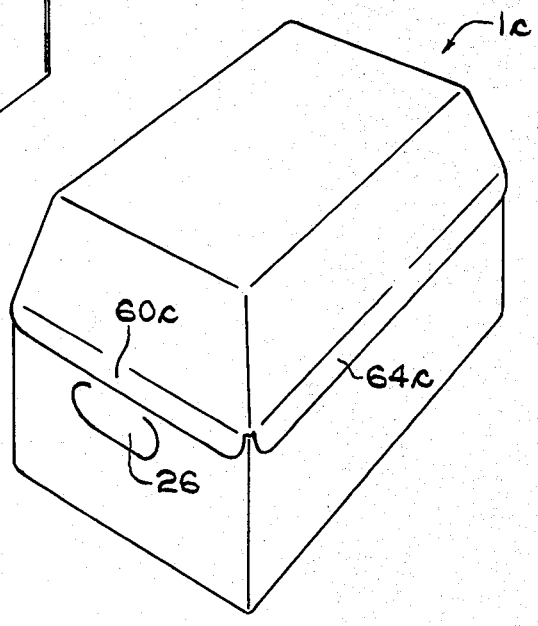
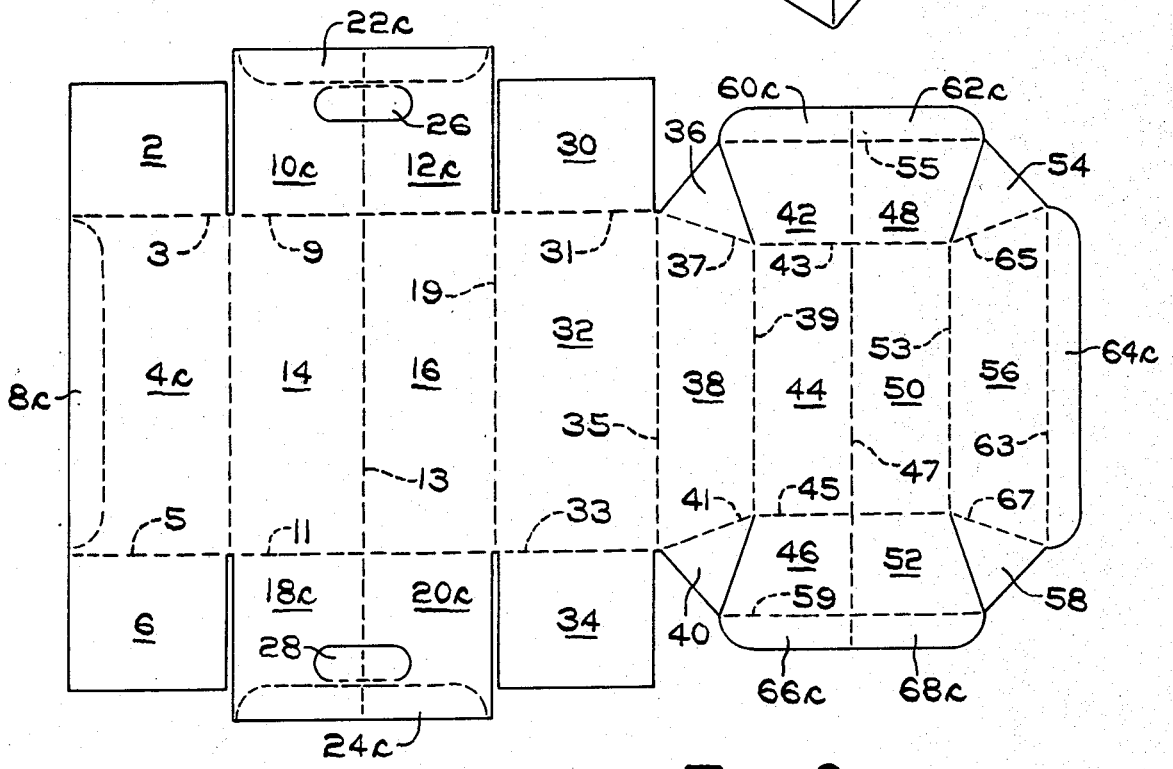
FIG. 9

FOLDING CARTON STRUCTURE

BACKGROUND OF THE INVENTION

Folding cartons have a long history as containers for beverage bottles, and particularly for beer bottles. At first, these bottles were almost entirely of the returnable nature and thus cartons were required to withstand both transport to the place of consumption and return of the bottles to the place of purchase. The containers typically employed for this purpose included a plurality of pockets formed from intersecting webs of heavy paperboard carried within a generally rectangular folding carton. These cartons were both loaded and unloaded from the top and typically included a pair of top closure flaps which were hinged to the front and rear walls and folded against each other in the center.

After years of employing returnable bottles, the trend then moved towards throw-away non-returnable bottles. Since these bottles were not designed to be returned to the place of purchase, the cartons employed for carrying them were of a completely different nature. Typically, these cartons were formed of a lighter weight paperboard and included a plurality of pockets and an upstanding handle to form the traditional "six-pack".

More recently, with the ever increasing emphasis on ecology and its demand for litter control and recycling, along with litter control or "bottle bills" being enacted by some state legislatures, returnable bottles are making a comeback. However, with inflation and increased shipping costs, the old-fashioned heavy paperboard carton for returnable bottles is no longer completely acceptable. Thus, a lightweight structure, which does not require the intersecting webs of paperboard is desired. It is thus one purpose of the present invention to provide a carton for beverage bottles, and particularly returnable beer bottles, which is designed to protect the bottles without the necessity of internal padding by employing the close packing of the bottles to protect themselves.

It is also a desired property for such a carton to be end-loaded, for the convenience of the bottler during his high speed packaging operations, and at the same time the top-unloading, for the convenience of the consumer. It is also a primary object of the present carton structure to be both end-loading and top-unloading.

Additionally, it is desired that the carton be one-piece and use as little paperboard as possible, to reduce the cost of the container, and yet retain a carrying structure which is simple to operate and reliable. It is thus an additional object of the present invention to provide such a carrying feature.

THE PRESENT INVENTION

By means of the present invention, a folding carton structure having all of the above-identified desired features is produced. The folding carton of the present invention is formed of a single blank of paperboard or an aluminum foil-paperboard laminate. The carton includes a rectangular bottom wall, a front wall, a rear wall and a pair of side walls which are perpendicular to the bottom wall, a rectangular top wall having its length and its width of lesser dimension than the bottom wall and generally trapezoidal front, rear and side connecting walls descending from the top wall, with the rear trapezoidal wall being hingedly attached to the rear wall to form a closure over the side and front walls. The front and side trapezoidal connecting walls each include an opening panel for easy opening of the carton after it is adhesively secured without causing structural damage to the carton. In a preferred embodiment, the side walls each include an opening cut partially therethrough to form hinged hand holes, with the bottom edge of the side opening panels being substantially colinear with the top edge of these partial openings to reinforce the hinged hand holes.

BRIEF DESCRIPTION OF THE DRAWINGS

The folding carton structure of the present invention will be more fully described with reference to the drawings in which:

FIG. 1 is an isometric view of a first embodiment of the carton of the present invention in its open position;

FIG. 2 is a isometric view of the first embodiment of the carton of the present invention in its closed position;

FIG. 3 is a top planar view of the carton blank employed to form the carton structure illustrated in FIGS. 1 and 2;

FIG. 4 is an isometric view of a second embodiment of the carton of the present invention in its open position;

FIG. 5 is an isometric view of the second embodiment of the carton of the present invention in its closed position;

FIG. 6 is a top planar view of the carton blank employed to form the carton structure illustrated in FIGS. 4 and 5;

FIG. 7 is an isometric view of a third embodiment of the carton of the present invention in its open position;

FIG. 8 is an isometric view of the third embodiment of the carton of the present invention in its closed position;

FIG. 9 is a top planar view of the carton blank employed to form the carton structure illustrated in FIGS. 7 and 8.

DETAILED DESCRIPTION OF THE PREFERRED EMBODIMENTS

FIGS. 1, 2, 4, 5, 7 and 8 illustrate the folding carton structure of the present invention. The embodiments of FIGS. 1 and 2, 4 and 5, and 7 and 8 differ from one another only with respect to the closing feature employed. The numbers on the various FIGURES are identical to one another, with the differences between the embodiments being illustrated by means of letters. Thus, "a" letters refer to differences of the embodiment of FIGS. 1, 2 and 3, "b" refer to the differences of the embodiment of FIGS. 4, 5 and 6 and "c" refer to the differences of the embodiment of FIGS. 7, 8 and 9.

Turning to FIGS. 1, 2 and 3, a first embodiment of the folding carton structure 1*a* is illustrated. The carton structure 1*a* includes a rectangular bottom wall formed from panels 14 and 16, a front wall formed from panel 4*a*, a left side wall formed from panels 10*a* and 12*a*, a right side wall formed from panels 18*a* and 20*a* and a rear wall formed from panel 32. The top wall of this carton structure 1*a* is formed from panels 44 and 50, which form a rectangular wall of lesser length and width dimensions than the bottom wall. Extending from the top wall are a generally trapezoidal front connecting wall 56, a generally trapezoidal left side connecting wall formed from panels 42 and 48, a generally trapezoidal right side connecting wall formed from panels 46 and 52 and a generally trapezoidal back connecting wall 38. The generally trapezoidal back connecting wall 38 is hingedly connected by means of score line 35 to the upstanding back wall 32.

Two methods may be employed for folding the carton structure of the present invention from a carton blank. In a preferred embodiment, the carton is provided to the bottler in a tubular form, with front opening panel 64*a* being adhesively secured to upstanding front panel 4*a* and the carton being folded to form a tube along score lines 13 and 47. Alternatively, the carton may be provided to the bottler as a flat blank structure in which the bottles to be packaged would be placed on panels 14 and 16 forming the bottom wall and the blank folded around the bottles with the panel 64*a* then being adhesively secured to upstanding front panel 4*a*. If the carton structure is provided in a flat blank form, score lines 13 and 47 need not be provided.

After the bottles are placed within the carton structure, whether it be by end loading through a tubular blank or by wrapping a flat blank around the bottles, the various panels are then folded and glued to complete the erection of the completed carton. Panels 36 and 54 are folded inwardly along lines 37 and 65 respectively on the left side of the carton while panels 40 and 58 are folded inwardly along lines 41 and 67 respectively on the right side of the carton and an adhesive is applied to the outside of these panels. Next, panels 2 and 30 on the left side are folded inwardly along lines 3 and 31 respectively while panels 6 and 34 on the right side are folded inwardly along lines 5 and 33 respectively and an adhesive is applied to the outside of these panels. The left side wall formed from panels 10*a* and 12*a* and the right side wall formed from panels 18*a* and 20*a* are then folded upwardly along lines 9 and 11 respectively and glued to panels 2 and 30 and 6 and 34 respectively. Then, the left trapezoidal connecting wall formed from panels 42 and 48 is folded along score line 43 and adhesively secured to panels 36 and 54 while the right trapezoidal connecting wall is folded along score line 45 and adhesively secured to panels 40 and 58. Finally, panels 42 and 48 are attached to panels 10*a* and 12*a* while panels 46 and 52 are attached to panels 18*a* and 20*a*, forming the side trapezoidal connecting walls.

The attachment of the panels 42 and 48, 56 and 46 and 52 to panels 10*a* and 12*a*, 4*a* and 18*a* and 20*a* is accomplished by means of opening panels. Front trapezoidal connecting wall 56 is attached to panel 4*a* along opening panel 64*a*. Panel 4*a* is provided with a plurality of partially cut through areas 8*a*. Glue is applied to these partially cut through portions 8*a* and panel 64*a* overlaps the partially cut through portions 8*a* to accomplish the gluing operation. Similarly, panels 60*a* and 62*a* overlap partially cut through portions 22*a* on panels 10*a* and 12*a* and opening panels 66*a* and 68*a* overlap partially cut through portions 24*a* on panels 18*a* and 20*a*. When glued, a structurally sound carton 1*a* is provided. The partially cut through portions 8*a*, 22*a* and 24*a* provide for ease of opening of the carton structure. While these partially cut through portions are illustrated as being circular, they could take any desired shape. Tabs 70, 71, 72 and 74 are provided on the opening panels. The consumer may run his finger under the tabs and, due to the partially cut through portions 8*a*, 22*a* and 24*a*, delaminate the paperboard in these regions to easily open the carton structure. This delamination operation does not structurally damage the carton. Thus, while resealing is not possible, closure of the carton to its fully closed position is readily accomplished. This permits protection of the bottles in the carton from damage during transit and from light and heat after opening of the carton to maintain coldness of the remaining bottles.

The side walls formed from panels 10*a* and 12*a* and from panels 18*a* and 20*a* include handle elements 26 and 28 respectively. These handle elements are formed from a cut through bottom and side portion and a scored upper portion, as can best be seen in FIG. 3, to provide a hinged opening. As can best be seen in FIG. 2, the side closure panels formed from panels 60*a* and 62*a* and from panels 66*a* and 68*a* have a bottom line which is constructed and arranged substantially colinear with the hinge line of the handle elements 26 and 28 respectively. This provides reinforcement for the handle region and prevents collapse of the carton in the region of the handles.

Turning to FIGS. 4, 5 and 6, a carton structure 1*b* is illustrated. The basic structure of this carton is identical to that of FIGS. 1, 2 and 3. However, no partially cut through portions are provided on panels 4*b*, 10*b*, 12*b*, 18*b* or 20*b*. Instead, the opening panel formed from panels 60*b* and 62*b* include a tear strip 80, the opening panel 64*b* includes a tear strip 82 and the opening panel formed from panels 66*b* and 68*b* include a tear strip 84. These tear strips 80, 82 and 84 are zipped open, much in the manner of a zipper, to permit opening of the carton structure 1*b*. Once again, the bottom lines of the side opening panels are constructed and arranged to reinforce the handle structures 26 and 28, as previously disclosed.

FIGS. 7, 8 and 9 illustrate a third embodiment of the carton structure of the present invention 1*c*. Again, the variation is in the opening structure employed. In this opening structure, front wall 4*c*, the left side wall formed from panels 10*c* and 12*c* and the right side wall formed from panels 18*c* and 20*c* include partially cut through portions 8*c*, 22*c* and 24*c* respectively. These partially cut through portions 8*c*, 22*c* and 24*c* are in the form of single strips. The left opening panel formed from panels 60*c* and 62*c*, the front opening panel 64*c* and the right side opening panel formed from panels 66*c* and 68*c* are glued to these partially cut through regions 8*c*, 22*c* and 24*c* respectively. These partially cut through portions 8*c*, 22*c* and 24*c* act in the same manner as the partially cut through regions 8*a*, 22*a* and 24*a* in the embodiment of FIGS. 1, 2 and 3 such that upon lifting of the opening panels the partially cut through portions delaminate to permit opening of the carton structure. Once again, the side opening panels are constructed and arranged to reinforce the handle structures 26 and 28 in the same manner as in the previous embodiments.

The sizes of the various panels will vary according to the number and size of the bottles to be carried. The carton is thus sized to closely wrap and tightly pack the bottles without movement therebetween, such that dividers between the bottles will not be necessary. However, if desired, the package may be sized to accomodate such dividers.

From the foregoing, it is clear that the carton structure of the present invention provides a simple yet efficient one-piece folded carton structure which is lightweight, easy to handle and transport and which can be filled and emptied with ease.

While presently preferred embodiments of the present invention have been illustrated and described, it will be recognized that this invention may be otherwise variously embodied and practiced within the scope of the following claims.

I claim:

1. A folded carton structure comprising a rectangular bottom wall; front, side and rear walls perpendicular to said bottom wall; said side walls each including a handle means, said handle means each being hingedly attached along a hinge line at an upper portion thereof to one of said side walls; a rectangular top wall of lesser length and width dimensions than said bottom wall; generally trapezoidal front, rear and side connecting walls descending from said top wall, said rear connecting wall being hingedly connected to said rear wall; and opening panels connected to said front and said side connecting walls, said side opening panels having bottom edges thereof substantially colinear with said hinge lines of said handle means to thereby reinforce said handle means.

2. The carton structure of claim 1 wherein said front wall and said side walls each include at least one partially cut through portion which delaminates upon opening of said carton structure.

3. The carton structure of claim 2 wherein said partially cut through portions each comprise a plurality of circular portions.

4. The carton structure of claim 2 wherein said partially cut through portions each comprise a single strip portion.

5. The carton structure of claim 2 wherein said front opening panel and said side opening panels each include opening tabs.

6. The carton structure of claim 1 wherein said carton structure is formed of paperboard.

7. The carton structure of claim 1 wherein said carton structure is formed of a paperboard-aluminum foil laminate.

* * * * *